US006269947B1

(12) United States Patent
Chang

(10) Patent No.: US 6,269,947 B1
(45) Date of Patent: Aug. 7, 2001

(54) GOLF BAG HAVING MULTIPLE DECKS FOR ISOLATING CLUBS

(76) Inventor: Saeho Chang, 927 New Norwalk Rd., New Canaan, CT (US) 06840

( * ) Notice: Subject to any disclaimer, the term of this patent is extended or adjusted under 35 U.S.C. 154(b) by 0 days.

(21) Appl. No.: 09/173,545

(22) Filed: Oct. 16, 1998

(30) Foreign Application Priority Data

Jul. 25, 1998 (KR) ..... 1998-30033

(51) Int. Cl.[7] ..... A63B 55/04; A63B 55/06

(52) U.S. Cl. ..... 206/315.6; 206/315.3; 211/70.2

(58) Field of Search ..... 150/1.5, 105; 206/315.6, 206/315.3; 280/47.19; 211/70.2

(56) References Cited

U.S. PATENT DOCUMENTS

| | | | | |
|---|---|---|---|---|
| 1,840,663 | * | 1/1932 | Gallagher | 206/315.6 |
| 2,419,175 | * | 4/1947 | Spohrer | 150/1.5 |
| 2,546,416 | * | 3/1951 | Alter et al. | 150/1.5 |
| 2,685,317 | * | 8/1954 | Lace et al. | 150/1.5 |
| 2,879,819 | * | 3/1959 | Turnbull | 206/315.6 |
| 4,332,283 | * | 6/1982 | Rader | 150/1.5 |
| 4,383,563 | * | 5/1983 | Kirchhoff, Jr. | 206/315.6 |
| 5,071,147 | * | 12/1991 | Stansbury | 280/47.19 |
| 5,135,107 | * | 8/1992 | Ingraham | 206/315.6 |
| 5,228,566 | * | 7/1993 | Shenoha | 206/315.6 |
| 5,255,781 | * | 10/1993 | Dulyea, Sr. | 206/315.6 |
| 5,868,247 | * | 2/1999 | Schrader | 206/315.4 |
| 5,915,551 | * | 6/1999 | Vavro | 206/315.5 |
| 5,954,199 | * | 9/1999 | Straton | 206/315.6 |

* cited by examiner

*Primary Examiner*—Allan N. Shoap
*Assistant Examiner*—Tri M. Mai
(74) *Attorney, Agent, or Firm*—Jacobson Holman, PLLC

(57) ABSTRACT

A golf bag for protecting golf clubs including at least two decks formed at the top side of the golf bag and shaped and formed like stairs, wherein the height of each of the decks is tall enough to accommodate and protect the full length of club shafts and the height difference between the decks is defined to fully isolate club heads of the clubs in one deck from other club heads of the clubs in the other deck, and walls separating said decks, said walls extended to the bottom of the golf bag in order to protect the club shafts of one deck from the club shafts of the other deck.

3 Claims, 4 Drawing Sheets

GOLF BAG HAVING MULTIPLE DECKS FOR ISOLATING CLUBS

BACKGROUND OF THE INVENTION

1. Field of the Invention

The present invention relates to a golf bag. More particularly, the present invention relates to a golf bag which includes at least two or more decks with significant height differences so that the clubs in each deck are completely isolated from the clubs in other decks, thus providing a better club protection when the bag is being transported or in motion.

2. Description of Related Art

Typical golf bags sold in the marketplace today have a shape of a cylinder with a single tier design at the top with a very slight angle. The height of these bags are about the length of a sand wedge and the head portion of golf clubs of various lengths stick out of the bag when they are placed in the bag. During transport by a person or golf cart, the clubs move back and forth due to rocking and shaking motions of the bag. Consequently, the clubs tend to hit each other when the bags are transported by a person or golf cart, causing the heads of the similar-sized clubs to strike each other. In addition, the shafts of the longer clubs, such as the driver and the woods, are continually struck by the heads of shorter irons and/or putter. Thus, not only the heads of all clubs are subject to damage, but particularly the shafts of taller clubs, which are typically made of graphite materials, are often damaged.

Golf club head covers are sometimes used for driver and woods with longer shafts, however, the impact of the hits among the golf clubs is often strong enough to go right through these covers and cause damage to the graphite shafts of these very expensive clubs. Frequently, the shaft and neck of very expensive driver or woods are broken as golf bags accidentally fall down to the side. Thus, club protections provided by head covers are insufficient.

Many top end of traditional golf bags are divided into several sections to allow clubs to be inserted in a sorted manner. Some dividers are designed to extend all the way down to the bottom of the bag. However, it is impossible to protect club shafts from being hit by other shorter clubs that are inserted right next to them within the same section or the shorter clubs that are put into one of the neighboring sections. Some bags today have a non-circular shape and a top end designed with many sections with slightly different heights that are somewhat apart from one another to keep the clubs away from each other as much as possible. But, again it is impossible to fully protect the clubs from each other because the physical separation of these sections are not sufficient and the top portions of the club shafts are still exposed well above the top of these golf bags.

Some bags are made with individual vertical tubes or compartments for each of the clubs. These bags provide better organization and easier club access in and out of the bag. However, the distance among the club holes are too small, and again good portions of the club shafts of longer clubs do stick out of the bag, thus being exposed for potential physical damage.

The clubs make undesired excessive noises when golf bags are transported by golf cart, thus bothering other players when they are trying to concentrate to hit their balls. In addition, the club vibrations while being transported by a golf cart are very severe and shorten the life of clubs. The shaft is damaged by not only by the one-sided, uneven distribution of head weight which causes a slight bend over time, but also from literally non-countable, visible and non-visible vibrations when the bags are shaken by a moving golf cart.

Clubs are typically inserted into the bag in a disorderly manner and it is difficult to find the needed clubs without often going through many clubs. Likewise, putting the clubs back into the same spot of golf bag is often a challenge. These problems waste golfers' time and unnecessary energy and attention away from the game. Also, when clubs are missing from golf bag, it is not easy to identify the missing clubs in today's bags since it is difficult to insert golf clubs in any organized fashion and the inserted golf clubs are often tangled up with each other.

Although golf bags come with a golf bag cover, the clubs move around freely within the golf bag during transportation, especially during traveling, thus causing damage to golf clubs. Club shafts, especially those of driver and woods that stick out of a golf bag the most, often break during transportation especially if the bag is handled improperly in cargo areas or is hit by other heavy luggage. Some people pack the bag with towels around the necks of long driver and woods to give an extra protection when they ship the golf bag through an airport.

People spend lots of money to protect their golf clubs and yet accomplish very little. They buy club head covers for woods and irons. They buy separate traveling golf bag covers into which the entire golf bag is inserted. Yet the clubs still move around inside the space within the golf bag cover which comes with the bag.

Traditional golf bags filled with clubs are often unbalanced due to the fact that clubs are often inserted in a disorderly manner causing uneven weight distribution. This causes the bag to fall and increase the possibility of damaging the club shafts.

The top section of some of the golf bags are designed with little tiny holes, sometimes with soft rubber material, to accommodate individual clubs. Although the movement of club shafts is reduced significantly when individual holes are made reasonably small, it is very difficult to put the clubs back into those small holes during the playing time. It is time-consuming and the players are often pressured with other things related to the game. More importantly, those tiny holes do not really protect club shafts; in fact, they make a ring around the graphite club shafts after some use. Also, the distances among those holes are too small to prevent the club heads from hitting the shafts of other nearby clubs.

SUMMARY OF THE INVENTION

The present invention is directed to a golf bag that substantially obviates one or more problems due to limitations and disadvantages of the related art.

A primary object of the present invention is to provide a golf bag which facilitates complete and comprehensive protection of golf club shafts through elimination of direct hits by other club heads in the same golf bag.

Another object of the present invention is to provide a golf bag which is easy to organize and access golf clubs as they are sorted into clusters and put into different decks and compartments.

Another object of the present invention is to provide a golf bag which facilitates time saving due to: elimination of the need for taking off and putting on club head covers during the game; and minimizing the time wasted to look for the right clubs during the game.

Another object of the present invention is to provide a golf bag which facilitates lowering the probability of losing golf clubs out in the field by enabling quick identification of a club loss through a quick visual check of missing clubs.

Another object of the present invention is to provide a golf bag which facilitates elimination or minimization of undesired, disturbing, and distracting noises that are caused by the clubs, hitting rapidly one another especially when they are carried on a cart during the game.

Another object of the present invention is to provide a golf bag which facilitates cost savings due to elimination of the need to purchase expensive golf club head covers, iron head covers, individual tubes designed to protect single club, and traveling bags.

Another object of the present invention is to provide a golf bag which facilitates much more even balance of the bag for the carrying the bag.

Another object of the present invention is to provide a golf bag which facilitates prevention of unexpected falling of the bag caused by uneven weight distribution and imbalance caused by disorderly inserted clubs in traditional bags.

To achieve these objects and provide other advantages, and in accordance with the purpose of the invention as embodied and broadly described, the invention provides a golf bag for protecting golf clubs, including at least two decks formed at the top side of the golf bag and shaped and formed like stairs, wherein the height of each of the decks is tall enough to accommodate and protect the full length of club shafts and the height difference between the decks is defined to fully isolate club heads of the clubs in one deck from other club heads of the clubs in the other deck, and walls separating said decks, said walls extended to the bottom of the golf bag in order to protect the club shafts of one deck from the club shafts of the other deck.

To achieve these objects and provide other advantages, and in accordance with the purpose of the invention as embodied and broadly described, the invention further provides a golf bag for protecting golf clubs, including at least two decks formed at the top side of the golf bag and slopping from the back to front significantly, wherein the height of each of the decks is tall enough to accommodate and protect the full length of club shafts and the height difference between the decks is defined to fully isolate club heads of the clubs in one deck from other club heads of the clubs in the other deck, and walls separating said decks, said walls extended to the bottom of the golf bag in order to protect the club shafts of one deck from the club shafts of the other deck.

To achieve these objects and provide other advantages, and in accordance with the purpose of the invention as embodied and broadly described, the invention further provides a golf bag for protecting golf clubs, including at least two decks formed at the top and center of the golf bag and shaped and formed like stairs, wherein the height of each of the decks is tall enough to accommodate and protect the full length of club shafts and the height difference between the decks is defined to fully isolate club heads of the clubs in one deck from other club heads of the clubs in the other deck, and walls separating said decks, said walls extended to the bottom of the golf bag in order to protect the club shafts of one deck from the club shafts of the other deck.

DETAILED DESCRIPTION OF THE PREFERRED EMBODIMENT

Figure 1:
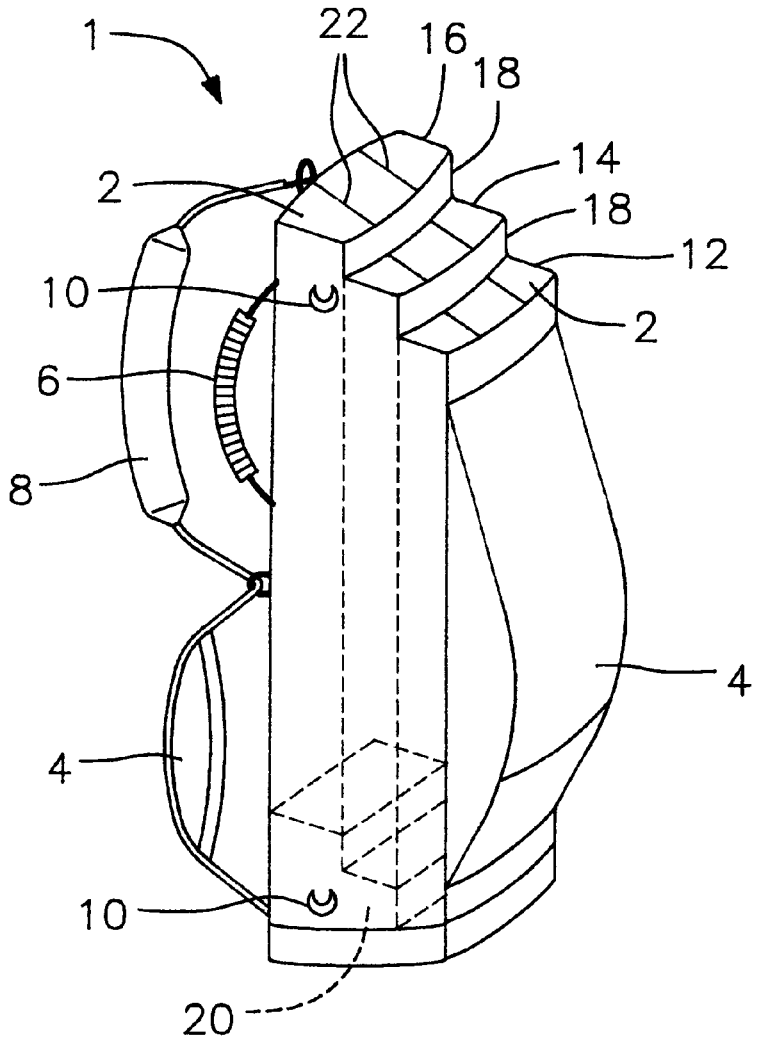
FIG. 1 is a perspective view of the golf bag according to the preferred embodiment of the present invention.

FIG. 1 shows a preferred embodiment of a golf bag 1 to illustrate the characteristics of the present invention. The top section of this golf bag 1 is structured like stairs and has distinctively and physically separated multiple decks with significant and unusual height differences. The walls 18 that separate the decks extend all the way down to the bottom of the bag 1. Each deck is designed to have several vertical club compartments which continue all the way to the bottom of the golf bag 1, forming a cylinder tube like space into which golf clubs are inserted. The exact shape of the tubes can vary depending on variables like: specific shape of the deck design, overall exterior shape of the bag 1, and the number of club compartments on each deck. Each club compartment 2 thus created can be designed to accept either only one or multiple clubs, depending on particular design intent of the golf bag 1. Other golf bag features like exterior pockets 4, golf bag handle 6, shoulder strap 8, umbrella holder 10, and towel hanger (not shown) are practically the same as those of other traditional golf bags in the marketplace, although they may vary somewhat by their design.

For practical use in the case of a golf bag shown in FIG. 1, one can, for instance, insert short iron clubs (e.g. putter, pitching, chipping, and sand wedges, as well as iron #9) into the appropriate club compartments (e.g. #9 and pitching into the first compartment; chipping and sand wedges into the middle compartment; and putter into the third compartment) belonging to the first deck 12. Likewise, one can also insert iron #3 to #8 into the second deck 14 (e.g. #3 and #4 into the first compartment, #5 and #6 into the middle compartment; and #7 and #8 into the third compartment) and likewise the relatively long woods and drivers into the third deck 16. The clubs in each deck are fully isolated from other clubs belonging to other decks, and unlike traditional bags, the full lengths of club shafts are mostly inserted into the bag 1 on each deck, providing club protection. In this situation, the use of traditional club head covers is redundant.

Although the preferred embodiment of the golf bag 1 shown in FIG. 1 has three decks, the number of decks in a given golf bag design can vary and the way that deck structure is accomplished can vary widely as it will be discussed later in conjunction with FIGS. 7A, 8A and 9A. Preferably, however, there are at least two or more decks for a given golf bag: The decks are fully and distinctively separated by their heights with each deck designed to accept a cluster of golf clubs with similar lengths: The height of each deck is determined by the lengths of the golf clubs assigned to a particular cluster that corresponds to each deck: The height of each deck is sufficiently tall to accommodate and protect the full lengths of the club shafts for the clubs belonging to a particular cluster assigned to each deck.

The top visible sections of the walls 18 that separate the decks, which runs all the way down to the bottom of the golf bag 1, are designed to fully protect the club shafts of the upper deck from the club heads of the lower deck. Thus, the club heads of the lower deck will hit the visible part of the walls and will not come into contact with the club shafts of any other deck.

Figure 2:
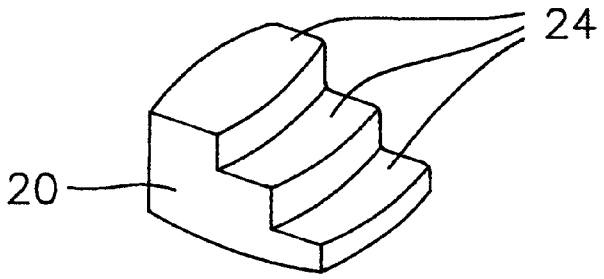
FIG. 2 is a perspective view of the inside bottom part of the golf bag according to the preferred embodiment of the present invention.

The heights of the top visible sections of the walls are preferably at least as higher as the thickness of the largest club head, and the height differences between the decks are intentionally exaggerated to ensure club shaft protection as required. The preferred height differences should be in a range between 1.5 and 10 inch. FIG. 2 shows a potential and optional design structure for the bottom part 24 of the golf bag 1 on which club grips rest when the clubs are inserted into the bag. Such structure for the bottom of a golf bag 1 may be required to achieve these intentional height differences for the golf bag in FIG. 1. Thus, for instance, the longest clubs may be placed on the top deck 16, and the shortest clubs on the lowest deck 12, to exaggerate the difference in height.

In the case of raised bottom part 24 as shown in FIG. 2, the space below the floor structure can be utilized for a storage space 20, thus reducing the need for exterior pocket space and maximizing the use of golf bag space. The bottom part 24 may be constructed as an insert that is placed inside the bag, or made as an integral part of the bag. However, the use of this raised bottom is not mandatory.

Figure 3:
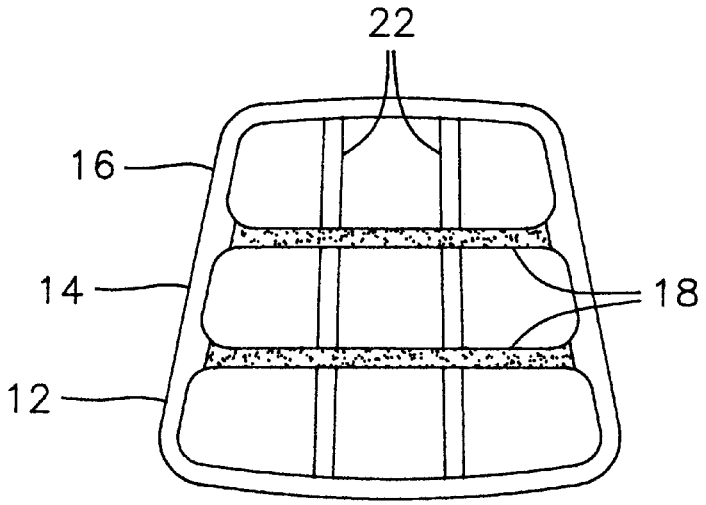
FIG. 3 is a top plan view of the golf bag according to the preferred embodiment of the present invention.

Each deck has vertical dividers 22 that divide the deck into multiple vertical sections. The vertical dividers 22 form multiple club compartments which are long cylinder-like and run all the way down to the bottom of the golf bag 1. The vertical dividers 22 rest on the bottom part 24, or may even be joined with the bottom part 24. Each compartment 2 can be designed to accommodate one or more clubs depending on a particular golf bag design. FIG. 3 shows a top plan view of the golf bag 1 shown in FIG. 1, showing the preferred shape of the compartments.

Figure 4:
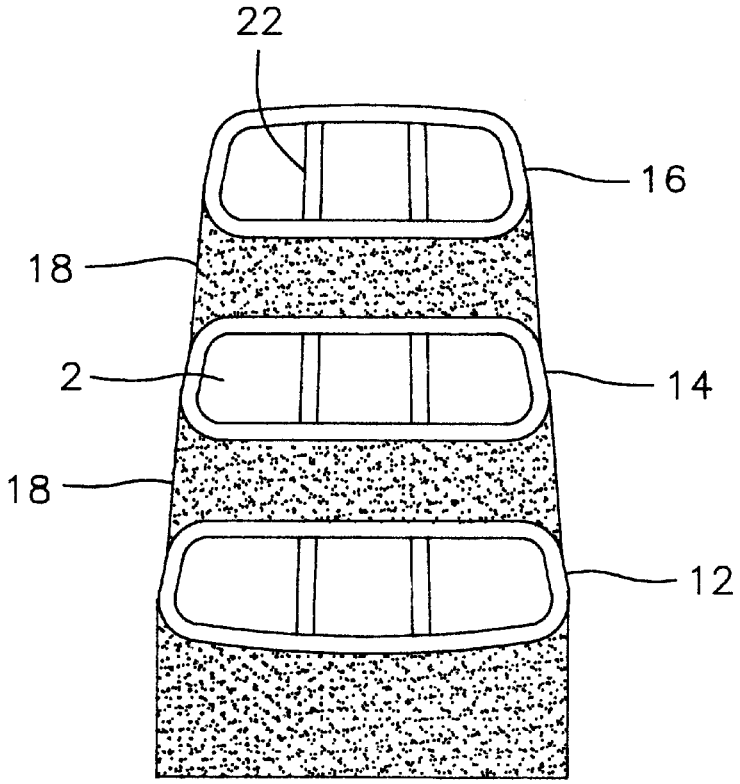
FIG. 4 is a top-front partial view of the top section of a golf bag according to the second embodiment of the present invention.

FIG. 4 shows second embodiment according to the present invention. This diagram shows a top-front view of a top section of a golf bag having a triple deck structure as shown in FIG. 1. Here, however, the decks are not leveled flat horizontally. As shown in FIG. 4, in this example, one end of a deck is slightly lower than the other end of the same deck, thus creating a stairs-like multiple deck structure which is tilted slightly to one direction. The design objective here is to allow each deck to accommodate the same cluster of golf clubs of similar lengths as described in the above explanation of FIG. 1, and yet to allow gradual and natural variation in deck heights to facilitate the differences of the club heights within the same assigned cluster.

For example, in order to more precisely accommodate the clubs assigned to a particular cluster belonging to the first deck 12, one can insert the short clubs like putter, chipping or sand wedges into the club compartment on the far left side of the first deck. Likewise, one can insert the longer irons like #9 or pitching iron into the club compartment on the far right side of the deck. This inclining feature within a given deck gives further convenience of assigning particular clubs to particular compartments, thus providing a further enhancement in organizing golf clubs, resulting in a quick access to desired clubs without wasting time and also a quick identification of missing clubs through a visual check. Also, in the case of the third deck 16, where the lengths of certain type of drivers can be extremely longer than other woods, this slopping structure of a deck can be especially helpful to differentiate the height of right side compartment from the left side compartment.

Figure 5:
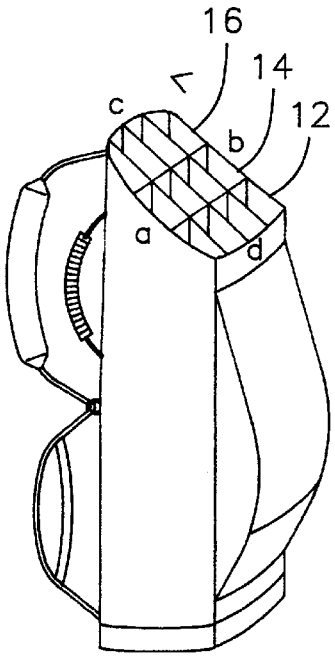
FIGS. 5 and 6 are perspective views of the golf bag according to a third and fourth embodiment of the present invention, respectively.
Figure 6:
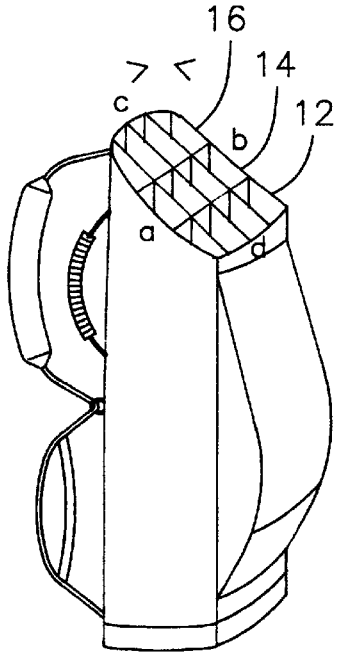

FIGS. 5 and 6 show yet another embodiments according to the present invention. While these bags at first may look similar to the traditional golf bags, the design concept and the actual construction methods are fundamentally different, and they are based on the main characteristics of the preferred embodiment. As shown in FIG. 5, from a structural point of view, the back-to-front angle of the slop (from c to d) in this bag is basically the same as the angle between the front edges of the third deck and the first deck of the golf bag shown in FIG. 1. Thus, the heights of the walls separating the decks remain the same. However, the edges of exterior side walls of the bag (a and b) and the edges of internal dividers that separated the club compartments are designed to have the same slop angle as the back-to-front angle (from c to d). This structure gives the same effects and benefits as the bag 1 shown in FIG. 1, as there are no changes to the fundamental characteristics of the preferred embodiment.

However, this bag 1 provides an extra benefit of creating taller and gradually inclining continuous side walls that further isolate the club heads within the perimeters of their own club compartments. The compartments prevent the clubs from rotating or moving into the spaces above the neighboring club compartments within a particular deck. In this scenario, the number of decks and the number of dividers can again vary from one golf design to another depending on design objectives, and yet all of the characteristics of preferred embodiment will remain the same.

FIG. 6 shows the same bag shown in FIG. 5, except that there is a built-in declining slope from the right side of the bag to the left side (from b to a). The heights of the dividers 22 are also adjusted so that they become gradually taller in between a and b. It should be noted that this concept is again similar to the concept illustrated in FIG. 4. Again, the number of decks and the number of club compartments can vary depending on specific design objectives.

FIGS. 7A, 7B, 8A, 8B, 9A and 9B illustrate yet another embodiments according to the present invention in terms of how the top section of a golf bag 1 can look significantly different depending on how the technology is employed to form a multiple deck structure. As illustrated, the shape of individual club compartments, or the top plan view of individual compartments, can vary widely depending on the employed overall design approach.

Figure 7A:
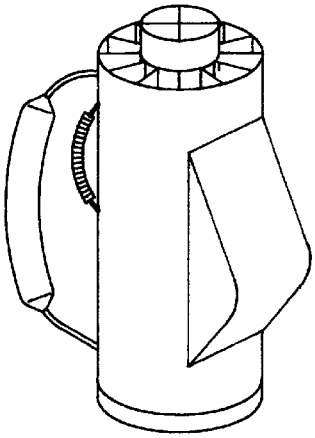
FIG. 7A is a perspective view of the golf bag according to a fifth embodiment of the present invention.
Figure 8A:
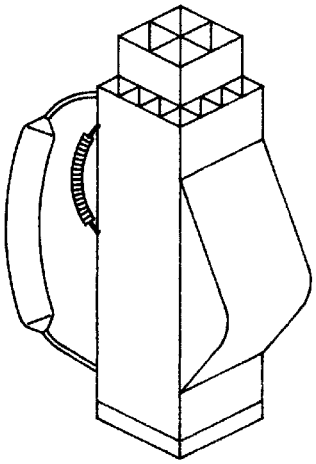
FIG. 8A is a perspective view of the golf bag according to a sixth embodiment of the present invention.
Figure 7B:
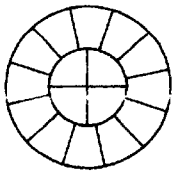
FIG. 7B is a top plan view of the golf bag according to the fifth embodiment of the present invention.
Figure 8B:
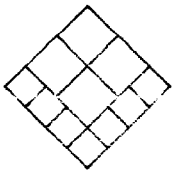
FIG. 8B is a top plan view of the golf bag according to the sixth embodiment of the present invention.

As shown in FIGS. 7A and 7B, the higher deck is formed in the middle part of the golf bag according to this embodiment. In this embodiment, the shape of the deck is circular. Similarly, FIGS. 8A and 8B illustrate another embodiment which has a higher deck formed at the top of the bag. However, in this embodiment, the higher deck may be rectangular and against one corner. A bottom part (not shown) may also be provided that complements the shape and design of these bags. All parts of the decks and walls are preferably made of a hard plastic and the edges of the decks may be covered with a soft rubber or similar materials to further protect the clubs from damage during transport. The bottom part 24 may be constructed of a hard plastic to retain its shape and durability.

Figure 9A:
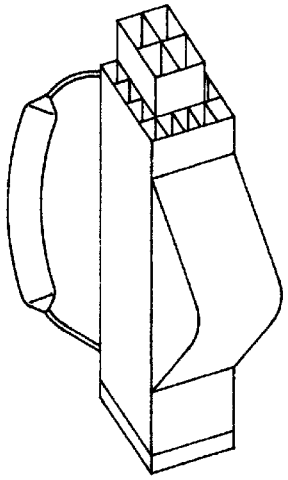
FIG. 9A is a perspective view of the golf bag according to a seventh embodiment of the present invention.
Figure 9B:
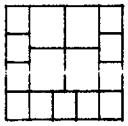
FIG. 9B is a top plan view of the golf bag according to the seventh embodiment of the present invention.

FIGS. 9A and 9B illustrate another embodiment which has a higher deck formed at the top of the bag. In this embodiment, the higher deck is against one side of the bag.

Figure 10A:
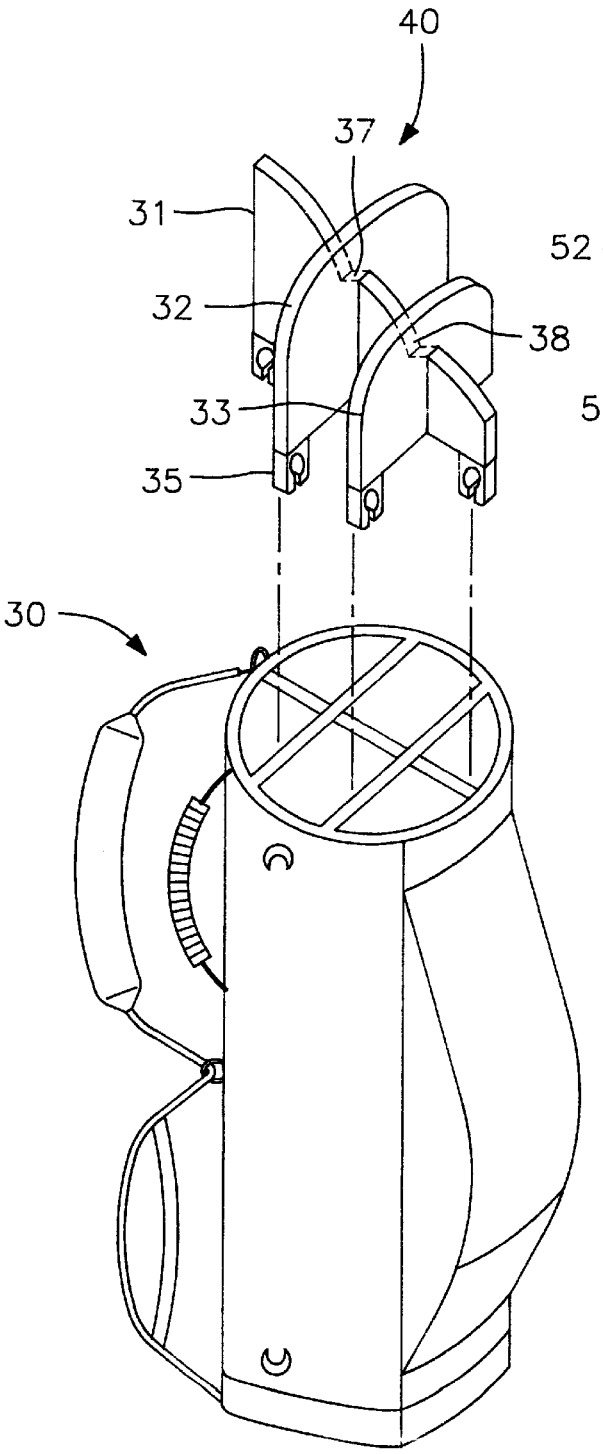
FIG. 10 is a perspective view of the modular attachment to an existing golf bag according to the eighth embodiment of the present invention.
Figure 10B:
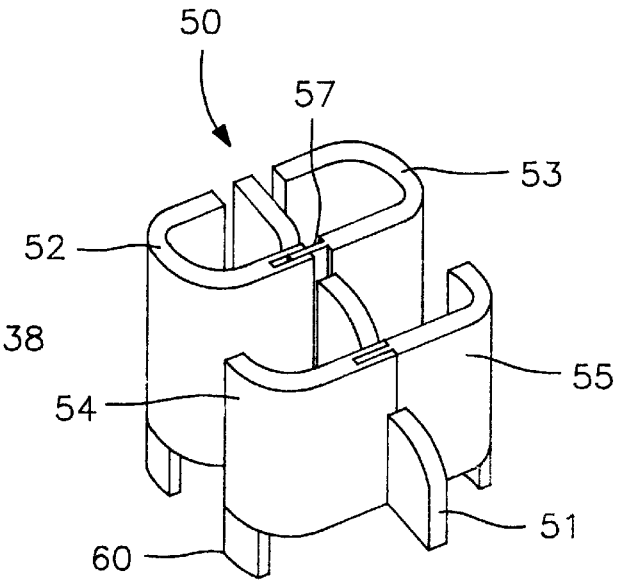

FIG. 10 illustrates another embodiment of the invention that is realized by creating a modularized golf bag attachment which can be installed at the top section of the existing conventional bags to take the advantage of this invention. FIG. 10 shows a typical conventional golf bag 30 which does not have the features of multiple decks as discussed in FIG. 1. In FIG. 10, two examples of potential modular attachments 40 and 50 are illustrated. Both are made of a number of pieces that can be put together at the time of installation.

The first type of modular attachment 40, for instance, is consisted of a club compartment divider 31 deck separation and walls 32, 33 that separate the decks and their heights should be the same as described in FIG. 1. The divider 31 separates club compartments within a deck. In this modular attachment 40, the divider 31 is designed with flat surface area 37 38 so that the walls 32, 33 can be moved back and forth depending upon the existing design of the golf bag 30. At the bottom of each assembled pieces are special securing member 35 which, in this case, are made of specially molded plastic which will slide tightly into the top edges of the golf bag 30.

The second type of modular attachment 50 is an another example in which the walls separating the decks are consisted of two moving pieces 52 and 53, and 54 and 55. This modular attachment includes a club compartment divider 51. They are made to be adjusted to the width of the golf bag 30 by using a width adjustment member 57, and they are designed to wrap-around the golf bag 30 to create side walls of the decks to create multiple decks shape like the golf bag shown in FIG. 1. In this type, a different securing member 60 is employed. The securing member 60 is simply a Velcro material which will attach to the other matching Velcro piece which will be glued onto the side edge of the golf bag 30. Obviously, the securing member can be made of a plastic screws which can be tightened against the edges of the golf bag 30.

Other club securing devices are further described in copending applications entitled "GOLF BAG FOR SECURING GOLF CLUBS" and "GOLF CLUB SECURING AND PROTECTION DEVICE FOR A GOLF BAG", each to Chang and filed concurrently herewith, each of which are incorporated herein by reference.

It will be apparent to those skilled in the art that various modifications can be made in the golf bag or in the modular attachments to golf bag without departing from the spirit or scope of the invention. Thus, it is intended that the present invention covers modifications and variations of the invention within the scope of the appended claims and their equivalents.

What is claimed is:

1. A golf bag for protecting golf clubs, comprising:

at least three decks shaped and formed like stairs at a top of the golf bag to create a shortest deck, a middle deck and a tallest deck, a bottom of said golf bag including a staircase shaped raised bottom part having a lowest stair, a middle stair and an upper stair, wherein a height of each of the decks is tall enough to accommodate and protect club shafts and a height difference between the decks is defined to fully isolate club heads of the clubs in one deck from club heads of other clubs in the other decks; and walls separating said decks, said walls extended to the bottom of the golf bag, as defined by a respective stair of said staircase shaped raised bottom part, in order to protect the club shafts of one deck from the club shafts of the other decks;

said lowest, middle and upper stairs of said staircase shaped raised bottom part defining an upper surface of a unitary storage space located underneath said lowest, middle and upper stairs, said upper surface thereby providing the unitary storage space with three heights, with that portion of the space located beneath the upper stair having a greatest height, that portion of the space located beneath the lowest stair having a least height, and that portion of the space located beneath the middle stair having an intermediate height between that of the greatest height and the least height.

2. The golf bag as set forth in claim 1, wherein each deck is divided into a plurality of club compartments by vertical dividers, each club compartment accommodating at least two clubs.

3. The golf bag as set forth in claim 1, wherein each deck is divided into a plurality of club compartments by vertical dividers, said vertical dividers running to the bottom of the golf bag where such dividers rest on said staircase shaped raised bottom part.

* * * * *